United States Patent [19]

Parkins

[11] Patent Number: 4,655,102

[45] Date of Patent: Apr. 7, 1987

[54] LOCKSMITH TOOL FOR UNLOCKING MOTOR VEHICLE DOORS

[76] Inventor: Donald L. Parkins, 846 S. 35th Ave., Omaha, Nebr. 68105

[21] Appl. No.: 784,997

[22] Filed: Oct. 7, 1985

Related U.S. Application Data

[63] Continuation-in-part of Ser. No. 666,152, Oct. 29, 1984.

[51] Int. Cl.[4] ..... E05B 19/20

[52] U.S. Cl. ..... 81/15.9; 70/465

[58] Field of Search ..... 81/15.9, 484, 488; 29/278, 267; 254/131; 294/19, 26, 23.5; 70/465; 7/166

[56] References Cited

U.S. PATENT DOCUMENTS

| | | | |
|---|---|---|---|
| 927,546 | 7/1909 | Johnston | 294/23.5 |
| 1,826,337 | 10/1931 | Yurkovitch | 294/23.5 |
| 2,350,250 | 5/1944 | Pietrobon | 81/15.9 |
| 2,876,991 | 3/1959 | Read | 254/131 |
| 3,936,088 | 2/1976 | Williams | 294/26 X |

*Primary Examiner*—Roscoe V. Parker
*Attorney, Agent, or Firm*—George R. Nimmer

[57] ABSTRACT

Disclosed is improved locksmith tool of the probing type wherein a locksmith, stationed externally of a locked motor vehicle operator's compartment, inserts the elongate probing tool between the door glass window and the hollow door supporting the window, and fishes deeply beneath the glass pane within the hollow door for the lock-rod which (upon tool engagement and manipulation) will unlock the vehicle door. Unlike prior art elongate probing tools which entail the tedious and unreliable hooking-around flexure of the lock-rods, the improved elongate probing tool concept herein disclosed easily and reliably engages the lock-rod (whether it be of the horizontal or vertical type) with an aptly positioned sawteeth member as the tool forward lower end, and which sawteeth member includes at least two multi-teeth rows that occupy distinctly different planes.

11 Claims, 15 Drawing Figures

10
10A
5
22
31
21
20
30D
FL
30
32
33
30E
SL
30A
39
40U
40
42
34
35
TL
Y°
RS
20G
120
110
130
140
36
39A
30FF
40N
40L
40M
37
38
41
30F

LOCKSMITH TOOL FOR UNLOCKING MOTOR VEHICLE DOORS

RELATED APPLICATION

This application is a continuation-in-part of copending U.S. patent application Ser. No. 666,152, filed Oct. 29, 1984.

BACKGROUND OF THE INVENTION

Drawing FIG. 1 is a side elevational view of a typical prior art elongate probing tool 110 intended to permit a locksmith, stationed externally of a locked motor vehicle operator's compartment, to insert such tool between the vehicle door window pane and the hollow door support therefor to reach the lock-rod located deeply inside the hollow door. Prior art tool 110, which is typically fabricated by permanently bending a single elongate length of metallic rod stock "RS" into the uniplanar shape of FIG. 1, comprises:

a handle member 120;

as the tool intermediate portion, an elongate carrier member 130 extending longitudinally downwardly from the handle member 120; and as the tool forward and lower portion, a hook member 140.

In operating typical prior art tool 110, the locksmith continuously wields handle member 120 and as a first step inserts leadward hook member 140 and leadward portions of carrier member 130 between the vehicle door glass window pane and the hollow door support therefor whereby these two tool members become located deeply below the glass pane and interiorally the hollow door where is located the lock-rod portion of the vehicle door locking mechanism. Once the leadward hook member 140 is thusly deeply within the vehicle hollow door, the operator has to fish blindly and "feel for" the lock-rod with hook member 140. Upon ultimately successfully "feeling" the lock-rod, the final operational step requires adroitly hooking-around the lock-rod with the hook member 140 and applying manually exerted flexure pressure between the hook member and the lock-rod to move the latter sufficiently to unlock the vehicle door. With such prior art probing tool and operational steps, the final operational step is exceedingly cumbersome, tedious, time-consuming, and lacking reliability for efficient locksmithing.

OBJECT OF THE INVENTION

It is accordingly the general objective of the present invention to overcome the disadvantages and deficiencies of prior art probing tools intended to enable a locksmith, stationed externally of a locked motor vehicle operator's compartment, to unlock the vehicle door. Ancillary general objectives include providing an improved probing tool which enables the locksmith to accomplish such task more easily, quickly, and reliably, and especially during the final operational step of engaging the deeply obscured lock-rod (of whatever type encountered) and to move same sufficiently for actuating the door locking mechanism and thereby simplify the locksmith's task of unlocking the vehicle door.

GENERAL STATEMENT OF THE INVENTION

With the above general objective in view, and together with other ancillary objectives which will become more apparent as this description proceeds, the locksmith tool of the present invention, which enables the externally positioned locksmith to quickly and reliably unlock the vehicle door, is an elongate probing device broadly similar to those of the prior art, but differing in that the prior art hook member is replaced by an aptly positioned sawteeth member having hardened multi-teeth rows occupying a plurality of planes and adapted to frictionally biteably engage the lock-rod and in this manner more reliably and easily manipulate the lock-rod for actuating the vehicle door mechanism, and differing also from the prior art by utilizing a carrier member having a preponderant vertical-length and a minor horizontal-length, and together with other ancillary novel features which will become apparent as this description proceeds.

BRIEF DESCRIPTION OF THE DRAWING

FIG. 1 is a left side elevational view of the prior art locksmith tool 110 heretofore alluded to;

FIG. 2 is a left side elevational view of a first embodiment 10 of the locksmith tool concept of the present invention;

FIG. 3 is a bottom plan view of the first embodiment;

FIG. 4 is a frontal detail view of the first embodiment;

FIG. 5 is a sectional view taken along lines 5—5 of FIGS. 1, 2, 6, 10, 12, 13, and 15;

FIG. 6 is a left side elevational view of a second embodiment of the locksmith tool concept of the present invention;

FIG. 7 is a bottom plan view of the second embodiment 10A;

FIG. 8 is a frontal detail view of the second embodiment;

FIG. 9 is a sectional view similar to FIG. 5 but showing a resinous coating especially adaptable at the tool hand portion;

DETAILED DESCRIPTION OF THE DRAWING

Figures 1, 2, 3, 4, 5, 6, 7, 8, 9:
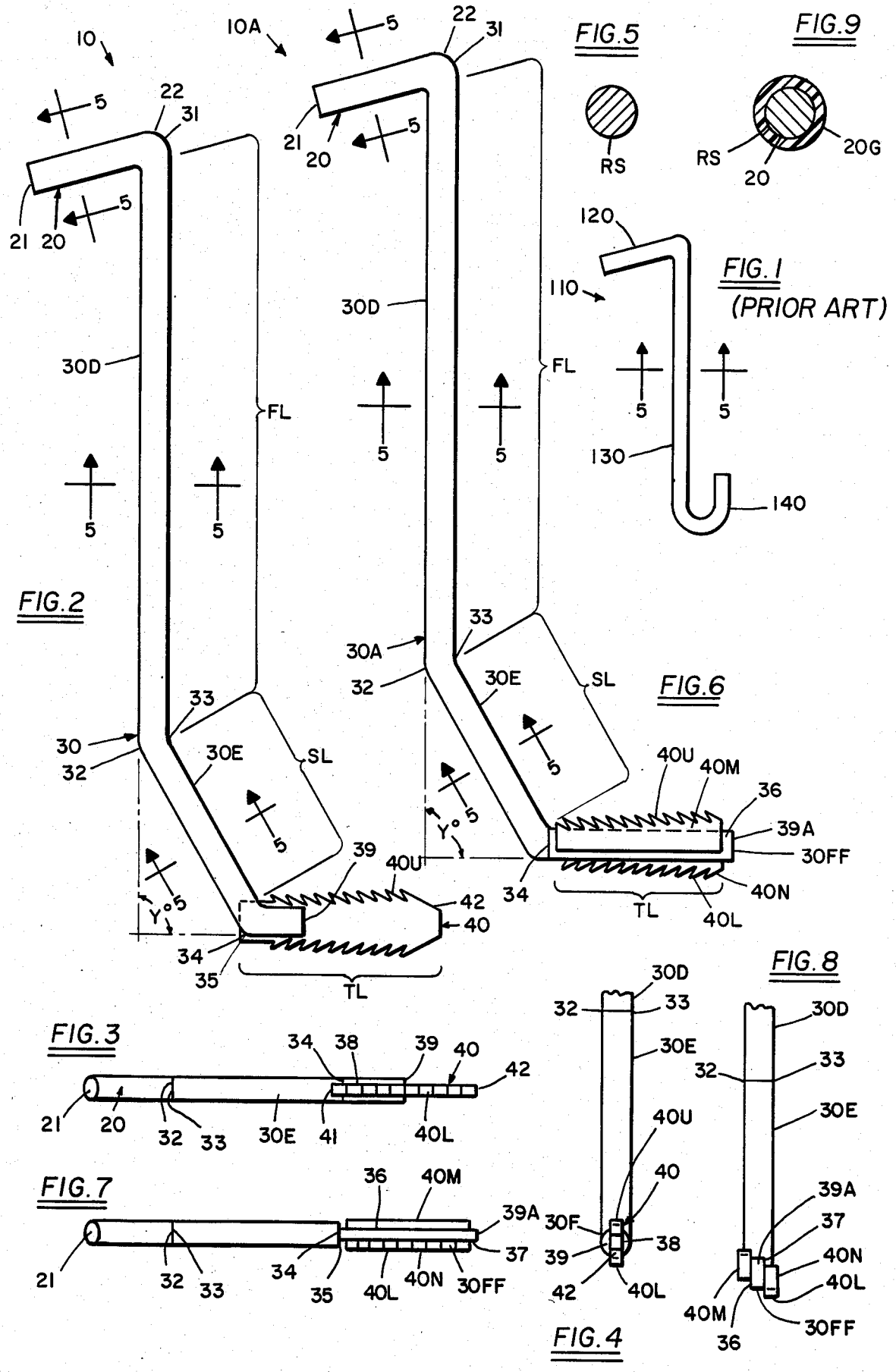
FIG.1 (PRIOR ART)

Drawing FIGS. 2–4 depict a representative embodiment (e.g. 10) of the locksmith tool concept for unlocking motor vehicle doors. The representative embodiment typifies the locksmith tool concept as follows:

(A) a linearly extending handle member 20 having a finite handle-length between a handle rear-end 21 and a handle front-end 22;

(B) as the tool intermediate portion, an elongate carrier member (e.g. 30) having a finite carrier-length between an upper trail-end 31 and a forward lower lead-end 39. The carrier-length (e.g. 31-39) is much lengthier than the handle-length. Moreover, such typical carrier-length predominately comprises a trailward vertical-length (e.g. 30D), but the remaining and leadward minority includes at least a generally horizontal horizontal-length (e.g. 30F); and (C) as the tool forward and lower portion, a substantially linearly extending sawteeth member (e.g. 40) having at least two multiteeth rows of length "TL" and rigidly connected to the carrier member adjacent the lead-end thereof.

In embodiment 10 of FIGS. 2–4, carrier member 30 includes a linearly extending uppermost vertical-length first-part 30D providing the carrier member trailing-length and trail-end 31, said first-part 30D being of finite vertical-length "FL" between trail-end 31 and a leadward-end 32 thereof. Vertical-length trail-end 31 is rigidly connected to the handle member front-end 22, and herein, linear handle member 20 extends angularly downwardly and rearwardly from carrier member vertical-length first-part 30D. Extending obliquely downwardly and forwardly from the first-part leadward-end 32 is a linearly extending second-part 30E which at its trailward-end 33 abruptly intersects and is rigidly connected to said vertical-length leadward-end 32. Second-part 30E has a finite second-length "SL" between trailward-end 33 and a leading-end 34, said second-length "SL" being at least twice as lengthy as sawteeth-length "TL" and being less than one-half the vertical-length "FL". Finally, carrier member embodiment 30 includes as its shortest, lowermost, and forwardmost part, a horizontal-length third-part 30F (which third-part also provides the carrier member lead-end 39) is provided with a central-slot 38; moreover such slot extends a short distance into second-part 30E. The angular relationship ($Y^0$) between the carrier member vertical-length 30D and its horizontal-length (e.g. 30F, 30FF, 30E2) is within the range of about 75° to 105°, and preferably substantially 90°.

Fabrication of the entire carrier member ( for embodiments 10, 10A, 10B, and 10C) might be commenced from a single elongate length of permanently bendable metallic rod stock ("RS") having a circular cross-sectional shape as seen in FIG. 5. The rod stock ("RS") diameter is typically on the order of about 0.15 to 0.20 inch. For carrier member 30 of embodiment 10, and together with handle member 20, a rod stock length of substantially 25½ inches is permanently bent into the uniplanar shape shown in FIG. 2 whereby the following lengths result: a handle length of three inches; a vertical-length (30D) of eighteen inches; a second-length (30E) of four inches; and a third-length (30F) of about one-half inch. Then, said slot 38 is sawed into the bent carrier member 30. For the second embodiment 10A, a rod stock length of substantially 26¼ inches is permanently bent into the uniplanar shape shown in FIG. 6 whereby the following lengths result: a handle-length of three inches; a vertical-length (30D) of eighteen inches; a second-length of four inches; and a third-part horizontal-length (30FF) of about 1¼ inch. Then, said third-part 30FF is ground to provide flat sides 36 and 37. For the third embodiment 10B a length of, circularly cross-sectional rod stock is permanently bent into the uniplanar shape shown in FIG. 10, and the portions from 30J to 39B are similarly provided with opposed flat sides. For the fourth embodiment 10C, a length of circularly cross-sectional rod stock is permanently bent into the uniplanar shape shown in FIG. 13, and the portions from 30J to 39C are similarly provided with opposed flat sides.

The aforementioned sawteeth member for embodiments 10 and 10A includes both an upwardly extending upper-teeth row (40U) and a downwardly extending lower-teeth row (40L), each of said multi-teeth rows having a said sawteeth-length "TL" (e.g. about 1¼ inch). In the embodiment 10 of FIGS. 2–4, sawteeth member 40 comprises a single length (e.g. about 1¼ inch from 41 to 42) of double edge metallic band saw material of the hardened type commonly used in metal-cutting sabre saws. Such sawteeth member 40 is inserted into the aforedescribed slot 38 and is then rigidly attached, as by welding, to the carrier member third-part horizontal-length 30F whereby sawteeth member beveled fore-end 42 is forwardly of carrier member lead-end 39 and provides the forwardmost and lowermost extremity of tool 10. Sawteeth member 40 aft-end 41 is located slightly rearwardly of third-part 30F and into second-part 30E. It can be seen that multi-teeth rows 40U and 40L occupy respectively different horizontal planes.

Having now structurally described first embodiment 10, while also structurally alluding to common parts of embodiment 10A, the reader's attention is now turned to second embodiment 10A of FIGS. 6–8. Common to embodiments 10 and 10A are handle member 20, the carrier member first-part 30D and second-part 30E, and the multi-teeth rows 40U and 40L. Embodiment 10A has for its carrier member 30A a said relatively lengthier third-part 30FF having a beveled forward terminus 39A as the tool and carrier member lead-end. The sawteeth member for embodiment 10A comprises two multi-teeth lengths (e.g. of about 1¼ inch each) of single-edge metallic band saw material of the hardened type commonly used in metal-cutting hacksaws. Sawteeth strip 40M and strip 40N are rigidly attached, as by welding, to the opposed flat sides 36 and 37 of carrier member horizontal-length 30FF whereby both strips are slightly rearward of tool lead-end 39A. Sawteeth strip 40M provides upper-teeth row 40U extending upwardly from horizontal-length 30FF, and sawteeth strip 40N provides lower-teeth row 40L extending downwardly from horizontal-length 30FF.

Figure 10:
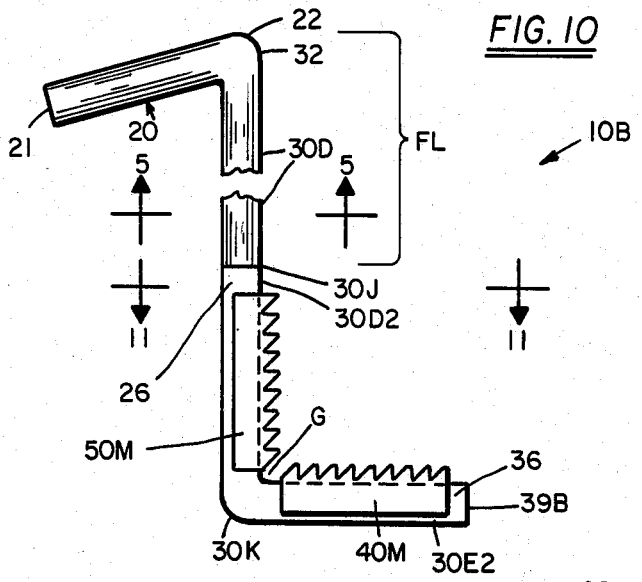
FIG. 10 is a left side elevational view of a third embodiment 10B of the locksmith tool concept of the present invention.
Figure 11:
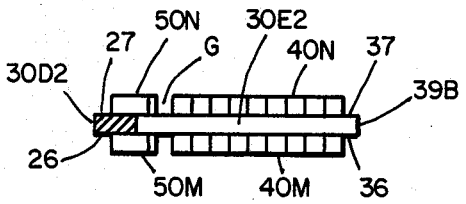
FIG. 11 is a sectional plan view taken along lines 11—11 of FIGS. 10 and 12.
Figure 12:
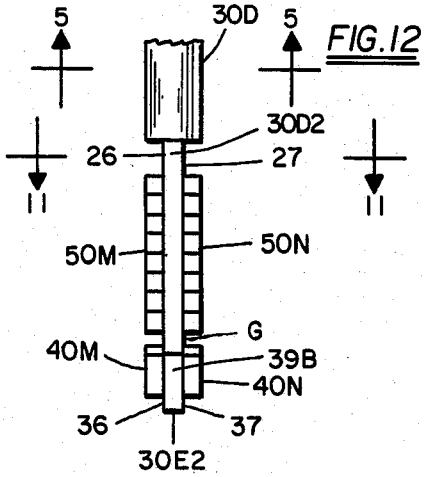
FIG. 12 is a frontal detail view of the third embodiment.

Having now described embodiments 10 and 10A, while also structurally alluding to common parts of embodiment 10B, the reader's attention is now turned to third embodiment 10B of FIGS. 10-12. Common to embodiments 10A and 10B are handle member 20, a carrier member vertical-length (e.g. 30D plus 30D2), and sawteeth strips 40M and 40N. As previously alluded to, below said distance "FL" (e.g. commencing at 30J), the carrier member vertical-length has opposed flat sides 26 and 27 and the carrier member horizontal-length 30E2 has opposed and respectively coplanar flat sides 36 and 37. Between carrier member first-corner 30K and leading-end 39B, minor length horizontal-length portion 30E2 carries said sawteeth strips 40M and 40N. Between first corner 30K and juncture 30J, the carrier member vertical-length carries similar sawteeth strips 50M and 50N. A finite-gap "G" exists between the horizontal plane of the multi-teeth rows of strips 40M-40N and the vertical plane of the multi-teeth rows of strips 50M-50N. All such multi-teeth rows extend away from finite-gap "G".

Figure 13:
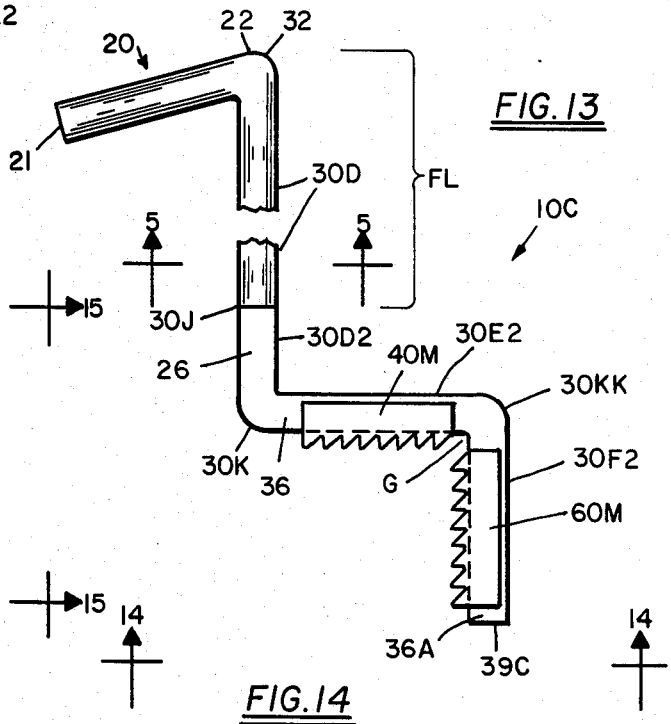
FIG. 13 is a left side elevational view of a fourth embodiment 10C of the locksmith tool concept of the present invention.
Figure 15:
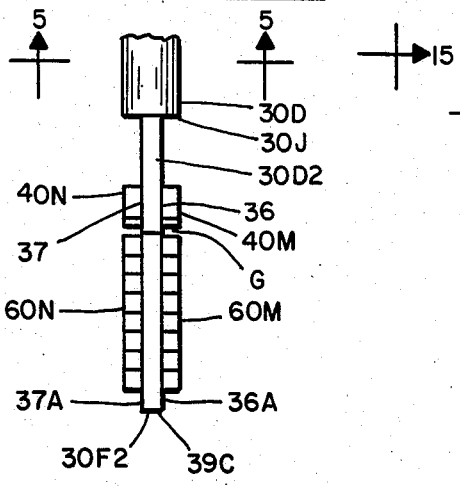
FIG. 15 is a rearward detail view of the fourth embodiment.
Figure 14:
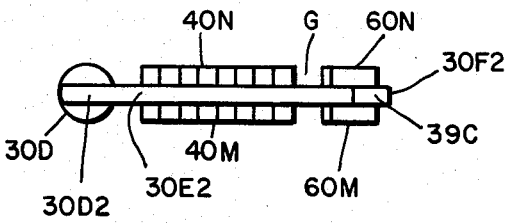
FIG. 14 is a bottom plan view taken along line 14—14 of FIG. 13.

Having now described embodiments 10, 10A, and 10B, while also structurally alluding to common parts of embodiment 10C, the reader's attention is now turned to fourth embodiment 10C of FIGS. 13–15. Common to embodiments 10A, 10B, and 10C are handle member 20, a carrier member vertical-length (e.g. 30D plus 30D2), and sawteeth strips 40M and 40N. As previously al-luded to, commencing at 30J, the carrier member vertical-length has opposed flat sides 26 and 27 and the carrier member horizontal-length 30E2 has opposed flat sides 36 and 37, coplanar with respective sides 26 and 27. Between carrier member first-corner bend 30K and second-corner bend 30KK, minor horizontal-length portion 30E2 carries said sawteeth strips 40M and 40N. Extending downwardly from the abrupt bend 30KK is an upright-length minor portion 30F2 for the carrier member. The opposed flat sides 36A and 36B of upright-length 30F2 carry sawteeth strips 60M and 60N, respectively. A finite-gap "G" exists between the horizontal plane of the multi-teeth rows of strips 40M-40N and the vertical plane of multi-teeth rows of strips 60M-60N. All such multi-teeth rows extend directionally away from finite-gap "G".

Drawing FIG. 9 indicates that a resinous grip material 20G might be adhered to rod stock "RS", and thus, provide a more comfortable and manipulatable handle member for the locksmith tool.

Operation of the locksmith tool concept herein (10, 10A, 10B, 10C, etc.) for unlocking motor vehicle doors is analagous to the three steps operation already described for the FIG. 1 prior art tool. However, by virtue of the unique carrier member having predominate vertical-length and minor horizontal-length portions, of the at least two distinct planes for the multi-teeth rows, and of other ancillary features described, all three operational steps are more easily, reliably, and quickly accomplished. Accordingly, such easy reliable engagement and manipulation of the visually obscured lock-rods permit the unlocking of motor vehicle doors by locksmiths within minimal times not possible with prior art tools.

From the foregoing, the locksmith tool concept for unlocking motor vehicle doors will be readily understood and further explanation is believed to be unnecessary. However, since numerous modifications and changes will readily occur to those skilled in the art, it is not desired to limit the invention to the exact constructions shown and described, and accordingly, further modifications and equivalents may be resorted to, as encompassed by the scope of the appended claims.

I claim:

1. For use with motor vehicle doors having an internally positioned lock-rod, a locksmith tool for probing and actuating said internally positioned lock-rod from the vehicle external side and said locksmith tool comprising:

(A) a handle member having a finite handle-length extending between a handle rear-end and a front-end;

(B) an elongate carrier member having a finite carrier-length between an upper and rearward trail-end and a lower and forward lead-end thereof, said carrier-length predominately comprising a trailward vertical-length and the remaining and leadward minority of said carrier-length including at least a generally horizontal-length, and said carrier-length being much lengthier than said handle-length; and (C) a sawteeth member rigidly attached to and extending along and confined to the carrier member nearer to the lead-end than to the trail-end, said sawteeth member comprising at least two substantially linearly extending multi-teeth rows, the said two sawteeth rows occupying distinctly different planes, and at least one of said sawteeth rows providing an angular relationship to the carrier member vertical-length within the range of about 75° to 105°.

2. The locksmith tool of claim 1 wherein the sawteeth member includes an upwardly extending upper-teeth row and also a downwardly extending lower-teeth row.

3. The locksmith tool of claim 1 wherein the sawteeth member comprises a plurality of multi-teeth lengths and arranged in a substantially L-shaped configuration.

4. The locksmith tool of claim 2 wherein the two multi-teeth rows take the form of a two edges and horizontally extending band saw material rigidly attached within a centrally slotted portion of the carrier member horizontal-length, and said band saw material extending horizontally forwardly beyond said carrier member horizontal-length.

5. The locksmith tool of claim 2 wherein the carrier member horizontal-length has a pair of opposed flat sides including a first-side and a second-side; and wherein the sawteeth member includes an upwardly extending upper-teeth row as a single-edge band saw material extending along and being attached to the horizontal-length first-side and also includes a downwardly extending lower-teeth row as a single-edge band saw material extending along and being attached to the horizontal-length second-side.

6. The locksmith tool of claim 3 wherein the carrier member vertical-length substantially perpendicularly intersects the carrier member horizontal-length at an abrupt first-corner; wherein the carrier member horizontal-length has a pair of opposed flat sides including a first-side and a second-side; wherein the carrier member vertical-length commencing at said abrupt first-corner has a pair of opposed flat sides including a left-side coplanar with said first-side and including a right-side coplanar with said second-side; and wherein the L-shaped configuration sawteeth member comprises:

(a) two separate lengths of single-edge band saw material extending along and being attached to the first-side and to the second-side, respectively, of the carrier member horizontal-length, and (b) two separate lengths of single-edge band saw material extending along and being attached to the left-side and to the right-side flat portions, respectively, of the carrier member vertical-length.

7. The locksmith tool of claim 3 wherein the carrier member vertical-length substantially perpendicularly intersects the carrier member horizontal-length at an abrupt first-corner; wherein the remaining and leadward minority of said carrier-length includes an upright-length substantially perpendicularly depending from the horizontal-length at an abrupt second-corner positioned remote from said first-corner; wherein the carrier member horizontal-length has a pair of opposed flat sides including a first-side and a second-side; wherein the carrier member upright-length commencing at said second-corner has a pair of opposed flat sides including a leftward-side coplanar with said first-side and including a rightward-side coplanar with said second-side; and wherein the L-shaped configuration sawteeth member comprises:

(a) two separate lengths of single-edge band saw material extending along and being attached to the first-side and to the second-side, respectively, of the carrier member horizontal-length, and (b) two separate lengths of single-edge band saw material extending along and being attached to the leftward-side and to the rightward-side, respectively, of the carrier member upright-length.

8. The locksmith tool of claim 1 wherein the entire carrier member and the handle member are together substantially uniplanar and fabricated as a result of permanently bending a single elongate length of metallic rod stock.

9. The locksmith tool of claim 8 wherein a resinous grip surrounds and is attached to the handle member.

10. For use with motor vehicle doors having an internally positioned lock-rod, a locksmith tool for probing and actuating said internally positioned lock-rod from the vehicle external side and said locksmith tool comprising:

(A) a handle member having a finite handle-length extending between a handle rearward-end and a front-end;

(B) an elongate carrier member having a finite carrierlength between an upper and rearward trail-end and a lower and forward lead-end thereof, said carrier-length predominately comprising a trailward vertical-length and also a generally horizontal-length having at least one flattened upright side; and (C) a sawteeth member rigidly attached to the said flattened upright side of the carrier member horizontal-length.

11. For use with motor vehicle doors having an internally positioned lock-rod, a locksmith tool for probing and actuating said internally positioned lock-rod from the vehicle external side and said locksmith tool comprising:

(A) a handle member having a finite handle-length extending between a handle rearward-end and a front-end;

(B) an elongate carrier member having a finite carrierlength between an upper and rearward trail-end and a lower and forward lead-end thereof, said carrier-length predominately comprising a trailward vertical-length and also a generally horizontal-length that is provided with an upwardly extending centrally-slotted position; and (C) a sawteeth member rigidly attached to the said centrally-slotted portion of said carrier member horizontal-length and extending along a horizontal plane vertically offset from said carrier member horizontal-length.

* * * * *